US011795898B2

(12) United States Patent
Sato et al.

(10) Patent No.: US 11,795,898 B2
(45) Date of Patent: Oct. 24, 2023

(54) STARTER SYSTEM FOR ENGINE

(71) Applicant: KAWASAKI MOTORS, LTD., Akashi (JP)

(72) Inventors: Minoru Sato, Akashi (JP); Junhei Asahi, Akashi (JP); Takuya Sekiguchi, Akashi (JP)

(73) Assignee: KAWASAKI MOTORS, LTD., Akashi (JP)

( * ) Notice: Subject to any disclaimer, the term of this patent is extended or adjusted under 35 U.S.C. 154(b) by 0 days.

(21) Appl. No.: 18/113,979

(22) Filed: Feb. 24, 2023

(65) Prior Publication Data

US 2023/0272768 A1 Aug. 31, 2023

(30) Foreign Application Priority Data

Feb. 25, 2022 (JP) ..... 2022-027556

(51) Int. Cl.
*F02N 11/08* (2006.01)

(52) U.S. Cl.
CPC ..... *F02N 11/087* (2013.01); *F02N 11/0862* (2013.01); *F02N 2300/106* (2013.01)

(58) Field of Classification Search
CPC ..... F02N 11/087; F02N 11/0862; F02N 2300/106; F02N 2011/0874; F02N 2011/0892
See application file for complete search history.

(56) References Cited

U.S. PATENT DOCUMENTS 8,428,855 B2 * 4/2013 Okumoto ..... F02N 11/0855 123/179.25
2013/0104829 A1 * 5/2013 Miyaki ..... F02D 41/062 123/179.3
2013/0181515 A1 * 7/2013 Harada ..... B60R 16/03 307/10.6
2017/0198674 A1 7/2017 Nishida

FOREIGN PATENT DOCUMENTS

JP 2017-125432 A 7/2017

* cited by examiner

*Primary Examiner* — Syed O Hasan
(74) *Attorney, Agent, or Firm* — Procopio, Cory, Hargreaves & Savitch LLP

(57) ABSTRACT

There is provided a starter system including: a starter motor configured to start an engine rotationally; an electronic control unit configured to control the engine; a battery that supplies a current to the starter motor; a starter switch capable of supplying the current of the battery to the starter motor in response to an operation by a user; a first circuit that supplies a starter signal indicating that the starter switch is operated to the electronic control unit; and a second circuit that supplies a current necessary for driving to the electronic control unit. The electronic control unit starts a control operation of the engine when there are both of the starter signal input from the first circuit and the current input from the second circuit.

10 Claims, 3 Drawing Sheets

STARTER SYSTEM FOR ENGINE

CROSS-REFERENCE TO RELATED APPLICATIONS

This application is based on and claims priority under 35 USC 119 from Japanese Patent Application No. 2022-027556 filed on Feb. 25, 2022, the contents of which are incorporated herein by reference.

TECHNICAL FIELD

The present application relates to a starter system for an engine used as a drive source of a straddle-type vehicle, for example.

BACKGROUND ART

JP2017-125432A discloses a motocross vehicle equipped with a starter motor. In the vehicle disclosed in JP2017-125432A, the engine is started to rotate by a starter switch.

SUMMARY OF INVENTION

In such a vehicle, it is important to improve the reliability of the starter system including an electronic control unit.

The disclosure of the present application provides a starter system for an engine capable of improving the reliability of the system.

According to an aspect of the present disclosure, there is provided a starter system including a starter motor configured to start rotation of an engine, an electronic control unit configured to control the engine, a battery configured to supply a current to the starter motor, a starter switch configured to supply the current of the battery to the starter motor by being operated by a user, a first circuit configured to supply a starter signal indicating that the starter switch is operated to the electronic control unit, and a second circuit configured to supply a current necessary for driving to the electronic control unit. The electronic control unit starts a control operation of the engine when there are both the starter signal input from the first circuit and the current input from the second circuit.

According to the starter system for an engine of the present disclosure, the electronic control unit starts the control operation of the engine when there are both the starter signal input from the first circuit and the current input from the second circuit. Therefore, since the user needs to perform a switch operation to start the engine, it is possible to prevent an undesired engine control from being started. As a result, the reliability of the system is improved.

DESCRIPTION OF EMBODIMENTS

Hereinafter, a preferred embodiment of the present disclosure will be described with reference to the drawings.

Figure 1:
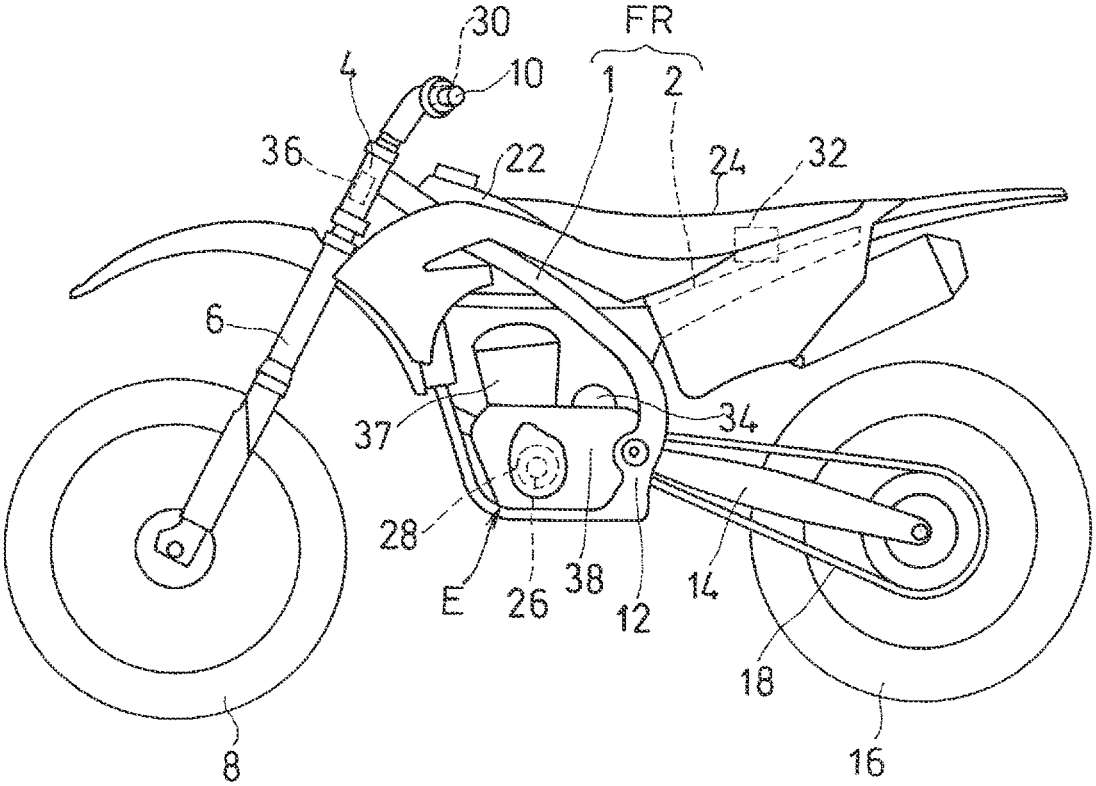
FIG. 1 is a side view showing a motorcycle, which is a type of straddle-type vehicle including a starter system for an engine according to a first embodiment of the present disclosure.

FIG. 1 is a side view showing a front portion of a motorcycle, which is a type of straddle-type vehicle including a starter system for an engine according to a first embodiment of the present disclosure. In the present specification, "right" and "left" refer to the "right" and "left" as viewed from a driver riding in a vehicle. In addition, "front" and "rear" refer to the "front" and "rear" in a traveling direction of the vehicle.

The motorcycle according to the present embodiment is a motocross type vehicle for competition. However, the motorcycle is not limited to the motocross type. A vehicle body frame FR of the motorcycle includes a main frame 1 configuring a front half portion of the vehicle body frame FR and a rear frame 2 configuring a rear half portion of the vehicle body frame FR. The main frame 1 extends rearward and obliquely downward from a head pipe 4 at a front end, and then curves downward and extends in an upper-lower direction. The rear frame 2 extends rearward from the main frame 1.

A front fork 6 is supported by the head pipe 4. A front wheel 8 is supported by a lower end portion of the front fork 6, and a handle 10 is attached to an upper end portion of the front fork 6.

A swing arm bracket 12 is provided at a rear end portion of the main frame 1. A swing arm 14 is vertically swingably supported by the swing arm bracket 12. A rear wheel 16 is attached to a rear end portion of the swing arm 14.

An engine E, which is a drive source, is disposed below the main frame 1 and in front of the swing arm bracket 12, and is supported by the vehicle body frame FR. Motive power of the engine E is transmitted to the rear wheel 16 via a power transmission member 18, so that the rear wheel 16 is driven. The power transmission member 18 is, for example, a drive chain. However, the power transmission member 18 is not limited to the drive chain.

A fuel tank 22 is disposed in an upper portion of the main frame 1, and a seat 24 on which an operator sits is mounted on the rear frame 2.

A generator 28 is attached to one end of a crankshaft 26, which is a rotating shaft of the engine E. The one end is, for example, a left end of the crankshaft 26. The generator 28 generates electric power by rotational power of the crankshaft 26. In the engine E according to the present embodiment, when a starter switch 30 provided on the handle 10 is operated, a current is supplied from a starter battery 32 to a starter motor 34 to start the starter motor 34, so that the engine E is started by the starter motor 34. The starter switch 30 is disposed, for example, on a right side of the handle 10. An engine control including a start control is performed by an electronic control unit (ECU) 36.

In the vehicle according to the present disclosure, when the starter switch is operated, the current of the battery starts to be supplied to electrical components other than the starter motor. For example, the electrical components to which the current of the battery is supplied in response to the operation of the starter switch include an electronic control unit that is a control device, and a fuel pump, an injector, and an ignition plug that are devices to be controlled by the control device. In addition, the electrical components may include various sensors to which a detection signal is input to the electronic control unit. In this way, the current of the battery is supplied in response to the operation of the starter switch. Therefore, in the vehicle according to the present embodiment, a main switch that is provided only for supplying the battery to the electrical components is omitted.

In the present embodiment, the starter battery 32 is disposed below the seat 24, the starter motor 34 is disposed behind a cylinder 37 of the engine E and above a crankcase 38, and the electronic control unit 36 is disposed below the handle 10. However, the arrangement of the starter battery 32, the starter motor 34, and the electronic control unit 36 is not limited thereto.

The functions of the electronic control unit 36 can be executed by using a general-purpose processor, a dedicated processor, an integrated circuit, Application Specific Integrated Circuits (ASIC), a circuit of the related art, and/or a circuit or a processing circuit that include a combination thereof, which are configured or programmed to execute the disclosed functions. Since the processor includes a transistor and other circuits, the processor is regarded as a processing circuit or a circuit. In the present disclosure, a circuit, a unit, or means is hardware that executes the listed functions or hardware that is programmed to execute the listed functions. The hardware may be hardware disclosed in the present specification, or may be other known hardware that is configured or programmed to execute the listed functions. When the hardware is a processor considered to be a type of circuit, the circuit, the means, or the unit is a combination of hardware and software, and the software is used for the configuration of the hardware and/or the processor.

Next, a starter system 40 shown in FIG. 2 of the engine E according to the present embodiment will be described. In the following description, an "upstream side" and a "downstream side" refer to an "upstream side" and a "downstream side" in a current flow direction. The starter system 40 includes the starter switch 30, the starter battery 32, the starter motor 34, and the electronic control unit 36, which are described above.

The starter system 40 includes a motor wiring portion D that supplies electric power of the starter battery 32 to the starter motor 34, a magnet switch 35 that is interposed in the motor wiring portion D and opens and closes the motor wiring portion D, a motor electromagnetic coil 33 for operating the magnet switch 35, a coil wiring portion F that is a wiring that supplies a current of the starter battery 32 to the motor electromagnetic coil 33, and the starter switch 30 that is interposed in the coil wiring portion F and opens and closes the coil wiring portion F. In the motor wiring portion D, the wiring is configured such that the current is larger than the current in the remaining wiring portion, in order to drive the starter motor 34. In other words, a current flowing through the electrical components other than the starter motor 34 is set to be smaller than the current flowing through the motor wiring portion D.

In the starter switch 30, an operation element operated by a user and a switch portion provided in the coil wiring portion F may be physically separated from each other. Even in this case, the starter switch 30 may be configured such that the switch portion switches an energization state of the coil wiring portion F in conjunction with an operation of the operation element. Thus, the motor wiring portion D is a wiring that connects the battery and the motor. The coil wiring portion F is a wiring that connects the starter battery 32, the starter switch 30, and the motor electromagnetic coil 33 in series.

When the operation element of the starter switch 30 is operated by a user operation, the starter switch 30 connects the interposed portion to energize the coil wiring portion F. As a result, the current of the starter battery 32 flows through the coil wiring portion F. The motor electromagnetic coil 33 is supplied with a current from the starter battery 32, thereby generating an electromagnetic force to turn on the magnet switch 35 to execute the energization process. As a result, the magnetic switch 35 connects the interposed portion to energize the motor wiring portion D. A current is supplied from the starter battery 32 to the starter motor 34 via the motor wiring portion D, and the starter motor 34 operates. Specifically, the starter motor 34 rotates the crankshaft 26 of the engine E to start the engine E rotationally. The starter motor 34 continues the energization process of the coil wiring portion F while the user is operating the operation element of the starter switch 30.

The starter system 40 includes a plurality of circuit wirings for supplying a current to the electronic control unit 36. The starter system 40 includes a first circuit 41 that supplies a starter signal indicating that the starter switch 30 is operated to the electronic control unit 36. The first circuit 41 supplies the current of the starter battery 32 to the electronic control unit 36 as the starter signal in response to an operation of the starter switch 30.

The first circuit 41 includes a signal supply portion 44 that supplies the current from the starter battery 32 to the electronic control unit 36 in response to the current being supplied from the starter battery 32 to the starter motor 34. The signal supply portion 44 branches from a downstream portion P3 of the starter switch 30 in the coil wiring portion F, and is connected to a first terminal that is a first input unit 48 of the electronic control unit 36. That is, when the starter switch 30 is turned on, the current of the battery is supplied from the starter battery 32 to the electronic control unit 36 via the coil wiring portion F.

The starter system 40 includes a second circuit 42 that supplies a current necessary for driving to electrical components other than the starter motor 34. The electronic control unit 36 is in an operable state when a current necessary for driving is supplied via a second input unit 50 to be described later. In the present embodiment, the second circuit 42 is configured to be able to supply the current of the battery to the electrical components as a current necessary for driving. Specifically, the second circuit 42 includes a startup time current supply portion A that is a wiring. The startup time current supply portion A branches from a downstream portion P4 of the starter switch 30 in the coil wiring portion F, and is connected to the second input unit 50 of the electronic control unit 36.

In the present embodiment, the second circuit 42 supplies power, which is a current from a power supply device 28 (that is, the generator 28) provided separately from the starter battery 32, to the electronic control unit 36. In the present embodiment, the power supply device 28 includes the generator 28 that generates electric power in accordance with a driving force of the engine E. In this case, the second circuit 42 includes a power generation time supply portion 56 connected from the power supply device 28 to the second input unit 50. In the present embodiment, the power generation time supply portion 56 is a section extending from the power supply device 28 to a merging portion P2 provided in the middle portion of the startup time current supply portion A.

While the starter switch 30 is operated, the current of the starter battery 32 is supplied to a second terminal, which is the second input unit 50 of the electronic control unit 36, via the startup time current supply portion A. The generated current is supplied to the second terminal 50 of the electronic control unit 36 via the power generation time supply portion 56 while the electric power is generated by the generator 28. When the electronic control unit 36 determines both the signal input from the first circuit 41 and the current input from the second circuit 42 via the input units 48 and 50, the electronic control unit 36 starts a control operation of the engine E. The start of the control operation of the engine E will be described later. In the present embodiment, the start of the control operation of the engine includes an operation of outputting a current supply command for supplying the current from the starter battery 32 to the electronic control unit 36.

The second circuit 42 includes a post-startup current supply portion B. The post-startup current supply portion B is a wiring for enabling the current of the starter battery 32 to be supplied to the electrical components as a current necessary for driving even after the starter switch 30 is operated. The post-startup current supply portion B is connected from the starter battery 32 to the second terminal 50 of the electronic control unit 36. Specifically, the post-startup current supply portion B is connected between a branch portion P1, which is an upstream portion of the starter switch 30 in the coil wiring portion F, and an upstream portion P5 of the startup time current supply portion A, which is upstream of the merging portion P2 to which the power generation time supply portion 56 is connected. A switching element 52 is interposed in the post-startup current supply portion B. The switching element 52 can be controlled by the electronic control unit 36, and opens and closes the post-startup current supply portion B. In this way, by merging at the merging portion P2 and the upstream portion P5, the number of terminals to which current is supplied to the electronic control unit 36 is reduced, and the number of terminals of the entire device can be reduced.

When there are both a signal input to the first input unit 48 and a current input to the second input unit 50, the electronic control unit 36 outputs a command for controlling the switching element 52 to a connection state as a current supply command to the starter battery 32. When a connection command is given from the electronic control unit 36, the switching element 52 executes an energization process of the post-startup current supply portion B. As a result, the current of the starter battery 32 is supplied to the electronic control unit 36 via the post-startup current supply portion B. The electronic control unit 36 can maintain a current supply state of the starter battery 32 to the electronic control unit 36 by continuously providing the connection command to the switching element 52 even after the input of the starter signal to the first input unit 48 is interrupted.

In the present embodiment, the switching element 52 is an electromagnetic relay. Specifically, the switching element 52 includes a switch 52*b* that is interposed in the post-startup current supply portion B, and switches the connection state, and an electromagnetic coil 52*a* that operates the switch 52*b*. The starter system 40 includes, in addition to the post-startup current supply portion B, a switch current supply portion C in which the electromagnetic coil 52*a* is interposed and which supplies the current of the starter battery 32 to the electronic control unit 36. The switch current supply portion C connects the starter battery 32 and a third terminal that is a third input unit 54 of the electronic control unit 36. In the present embodiment, the switch current supply portion C branches from a branch portion P7 on the upstream side of the switching element 52 in the post-startup current supply portion B, and is connected to the third input unit 54. In this way, by branching at the branch portion P1 and the branch portion P7, the wiring is partially shared, and the wiring can be shortened as a whole.

The electronic control unit 36 includes a switching unit 101 that switches a current supply state to the switch current supply portion C. The switching unit 101 is interposed in an internal wiring that connects the third input unit 54 and a grounding unit 55 connected to a ground portion of the electronic control unit 36. The switching unit 101 may employ an existing switch structure, may be a switch circuit including a transistor, or may be a semiconductor switch.

When the input current is supplied to both the first input unit 48 and the second input unit 50, the electronic control unit 36 operates the switching unit 101 to perform the energization process of electrically connecting the switch current supply portion C to the ground. As a result, the current of the starter battery 32 flows through the switch current supply portion C. The electromagnetic coil 52*a* interposed in the switch current supply portion C generates an electromagnetic force by the current of the starter battery 32 flowing therethrough, and turns on the switch 52*b*, that is, executes the energization process. The switch 52*b* is connected to the interposed portion, and executes the energization process of the post-startup current supply portion B. In this way, while the switching unit 101 of the electronic control unit 36 continues to operate, the current supply state of the starter battery 32 to the electronic control unit 36 is maintained via the post-startup current supply portion B.

The electronic control unit 36 determines an electrical state related to the current of the starter battery 32 supplied via the third input unit 54. A determination unit 102 is a so-called return check circuit, and determines whether a current is supplied from the starter battery 32. Specifically, the determination unit 102 includes a voltage determination circuit. The voltage determination circuit determines whether a voltage applied between the third input unit 54 and the grounding unit 55 falls within a threshold value range corresponding to a voltage applied from the starter battery 32. The electronic control unit 36 determines whether a combustion command of the engine E can be output based on the determination result of the determination unit 102.

In the present embodiment, the generator 28 constitutes a power supply device that supplies power to the electronic control unit 36. The power generation time supply portion 56 is provided with a regulator 58 for keeping an output of the generator 28 constant in the second circuit 42. However, the power supply device is not limited to the generator 28, and may be, for example, a capacitor, a battery, or the like.

The second circuit 42 supplies a current to the second input unit 50 of the electronic control unit 36. The switching element 52 is disposed between the branch portion P1 and the merging portion P2.

Sensor information necessary for the engine control is input to the electronic control unit 36. The sensor may be a gear position sensor, an intake pressure sensor, an atmospheric pressure sensor, an accelerator opening sensor, a gyro sensor, or the like, in addition to a crankshaft sensor 64 and a falling over sensor 66, which will be described later.

The electronic control unit 36 performs a combustion control as the engine control. The electronic control unit 36 adjusts a fuel injection amount and a fuel injection pressure by a fuel pump 61 and an injector 62 as an air-fuel ratio control. Further, as an ignition timing control, the electronic control unit 36 adjusts an ignition timing with respect to a movement of a piston by an ignition coil 63.

In the present embodiment, the starter system 40 includes an electrical component power supply portion G. The electrical component power supply portion G branches from a portion P8 on a downstream side of the merging portion P2 in the startup time current supply portion A, and is connected to each of control input units 61*a*, 62*a*, and 63*a* of the electronic control unit 36. The fuel pump 61, the injector 62, and the ignition coil 63, which are electrical components for a combustion control of the engine E, are individually interposed in the electrical component power supply portion G.

Switching units 103 to 105 are connected to the control input units 61*a*, 62*a*, and 63*a*, respectively. When the switching unit 101 switches between a connection operation and a connected operation, a driving state of the engine E to the electrical component for a combustion control can be switched. A combustion state of the engine E can be controlled by controlling the operations of the switching units 101 and 103 to 105 in accordance with information input from the sensor or a program stored in advance. For example, an air-fuel ratio and the ignition timing can be adjusted for each engine speed. The program for a combustion control may be updated in accordance with an instruction from the user.

The starter system 40 includes a noise reduction unit 60. Since the current of the starter battery 32 supplied from the signal supply portion 44 is input as a signal, the noise reduction unit 60 reduces an influence of noise. The noise reduction unit 60 is, for example, a resistance element, and can increase noise resistance to an input signal by setting a voltage threshold value. However, the noise reduction unit 60 is not limited to the resistance element. The noise reduction unit 60 may include, for example, a circuit for determining a current threshold value or a low-pass filter.

Next, the order of activation of the electronic control unit 36 according to the present embodiment will be described. First, the user turns on the starter switch 30. When the current flows through the coil wiring portion F, the current flows through the starter motor 34, and the crankshaft 26 is rotationally driven.

When the starter switch 30 is turned on, the current of the starter battery 32 is supplied as a starter signal to the electronic control unit 36 via the coil wiring portion F and the signal supply portion 44 (first circuit 41). In addition, while the starter switch 30 is operated, the current of the starter battery 32 is supplied to the second input unit 50 of the electronic control unit 36 as a drive current (second circuit 42) via the coil wiring portion F and the signal supply portion 44.

As described above, the electronic control unit 36 is in a controllable state when the drive current is supplied to the second input unit 50. In this state, when the electronic control unit 36 determines that the first input unit 48 receives the starter signal, the electronic control unit 36 starts the control operation of the engine E. In other words, the control operation of the engine E is started when the input of the current to both the first input unit 48 and the second input unit 50 is confirmed. Specifically, when the electronic control unit 36 determines that the current is input to the two input units 48 and 50, the electronic control unit 36 executes the energization process of the switching unit 101.

As a result, the current of the starter battery 32 flows to the switch current supply portion C, so that the current supply state of the starter battery 32 to the second input unit 50 of the electronic control unit 36 and the electrical components for a combustion control via the post-startup current supply portion B is maintained. While the supply of the current of the starter battery 32 via the second input unit 50 is maintained, the current supply state to the electrical components other than the starter motor 34 is maintained by maintaining the energization to the switching unit 101. In other words, even when the operation of the starter switch 30 is released, the current supply state to the electrical components other than the starter motor 34 is maintained.

When an impact is generated in the vehicle due to a landing operation or the like in jump traveling, there is a possibility that connection of the electromagnetic relay 52 is instantaneously interrupted. In the present embodiment, since the second circuit 42 is disposed downstream of the electromagnetic relay 52, as long as the engine E is rotating, even if the connection of the electromagnetic relay 52 is instantaneously interrupted, the electric power supply by the generator 28 can be continued, and the instantaneous interruption of the current supply to the electrical components including the electronic control unit 36 can be prevented.

Since the second circuit 42 is located downstream of the electromagnetic relay 52, the generated current may be unintentionally supplied to the electronic control unit 36 due to pushing-walking of the vehicle or the like. In the present embodiment, even in such a situation, since the user does not operate the starter switch 30, the electronic control unit 36 does not perform the engine control. In other words, since the operation of the starter switch 30 by the user is included in conditions for a combustion control of the engine, it is possible to prevent the engine from being started unintentionally by the user.

When the electromagnetic relay 52 is connected, the starter battery 32 can be charged with electric power from the generator 28. In addition, by supplying the current to each electrical component by the generator 28, it is possible to reduce the contribution of the battery 32 other than at the time of starting, and it is possible to realize a reduction in capacity and a reduction in size of the battery 32.

In the present embodiment, when the determination unit 102 determines that the current flowing through the switch current supply portion C is caused by the starter battery 32, the switching units 103 to 105 are controlled to perform the combustion control. In other words, when it is determined that the current of the starter battery 32 does not flow to the switch current supply portion C, the combustion control is not performed. As a result, it is possible to prevent the engine control from being continued while relay failure or relay disconnection state is maintained. For example, when the engine control is not performed, the user can easily recognize a relay failure state.

According to this configuration, the size of the starter battery 32 can be reduced by using the starter battery 32 only at the time of starting, that is, by using the starter battery 32 as a device for rotating the starter motor 34. In addition, if the generator 28 is increased in size, a rotational speed inertia force of the crankshaft 26 (FIG. 1) is increased, and thus it is easy to take measures against engine stall.

The electronic control unit 36 stops the combustion control of the engine based on the rotation stop of the engine E or falling of a vehicle body. Specifically, when it is determined that a first predetermined time has elapsed after determining the rotation stop, the energization process of the switching units 101 and 103 to 105 is stopped. Similarly, when it is determined that a second predetermined time has elapsed after determining the falling, the energization process of the switching units 101 and 103 to 105 is stopped. The first predetermined time and the second predetermined time may be the same or different. In addition, the combustion control of the engine may be stopped in response to a signal from the operation element for commanding an engine stop. By stopping the energization process of the switching unit 101 based on the engine stop or the falling, it is possible to reduce the power consumption due to the current supply in a stopped state. In addition, by maintaining the energization process of the switching unit 101 until the predetermined time elapses after determining the stop as mentioned above, it is possible to easily start re-traveling.

The stop of the engine E is detected by, for example, the crankshaft sensor 64, and the falling of the vehicle body is detected by, for example, the falling over sensor 66. However, a unit for detecting the stop of the engine E or the falling of the vehicle body is not limited thereto.

Figure 3:
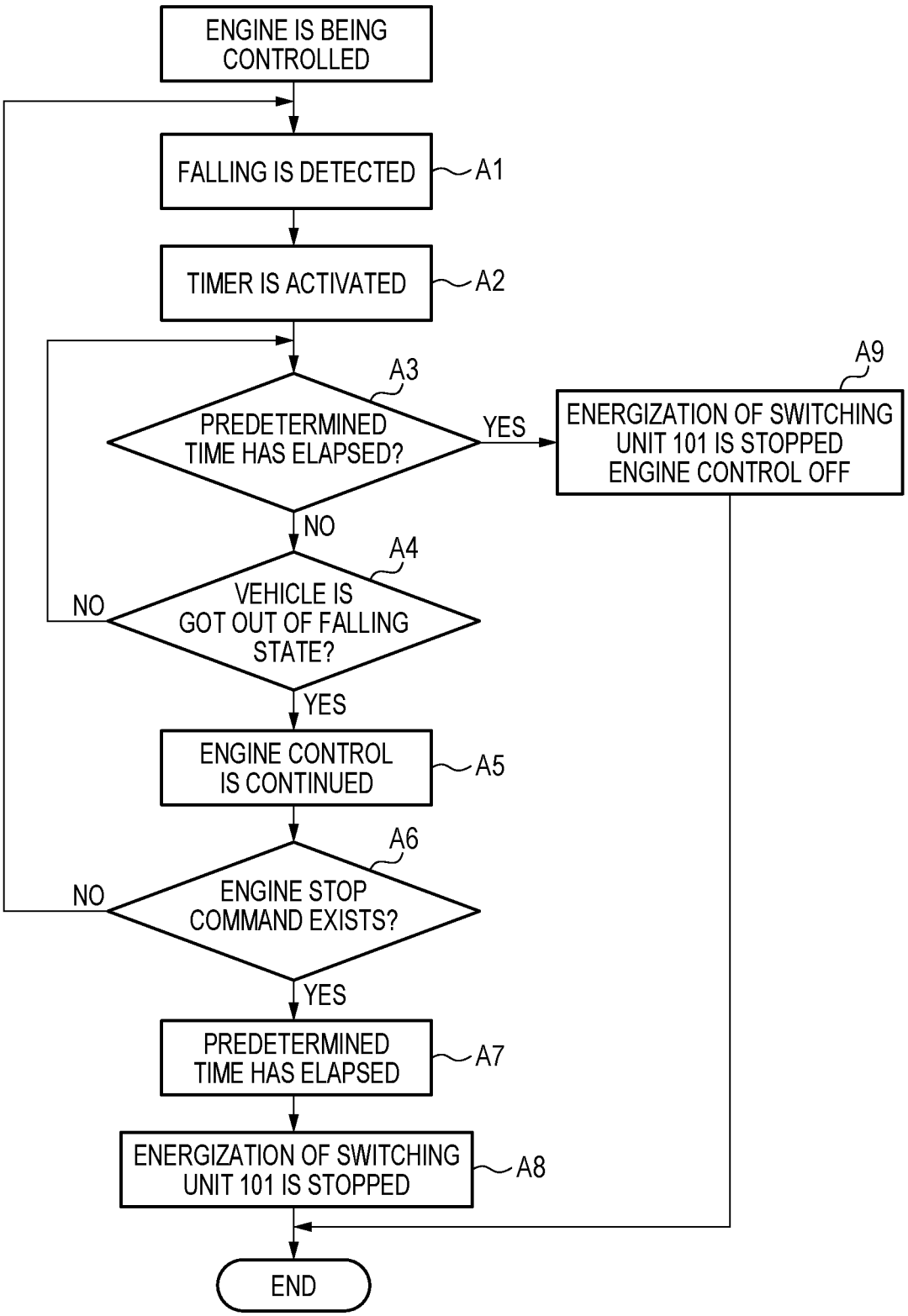
FIG. 3 is a flow chart of the starter system at the time of occurrence of an abnormality.

A flow of processing of the electronic control unit 36 in a case where the falling of the vehicle body is detected will be described with reference to FIG. 3. First, the falling of the vehicle body is detected by the falling over sensor 66 (process A1). When the falling of the vehicle body is detected, a timer is activated (process A2).

Next, it is determined whether a predetermined time has elapsed after the timer is activated (process A3). When the predetermined time has not elapsed, it is determined whether the engine E has gone out of a falling state (process A4). In this state, since an energization state by the switching unit 101 is maintained, the current supply state of the starter battery 32 to the electrical components for the combustion control is maintained. Therefore, by putting a state where the vehicle has gone out of the falling within the predetermined time, the traveling of the vehicle can be resumed without operating the starter switch 30 again.

When it is determined in process A4 that the vehicle does not get out of the falling state, the process returns to process A3. Further, when it is determined in process A4 that the vehicle is out of the falling state, the control of the engine E is continued (process A5).

Next, it is determined whether the engine stop command is issued (process A6). When it is determined in process A6 that the engine stop command is not issued, the process returns to process A1. When it is determined in process A6 that the engine stop command is issued, the energization of the switching unit 101 is stopped (process A8) after a predetermined time elapses (process A7). As a result, the engine control is disabled.

When it is determined in process A3 that the predetermined time has elapsed, the electronic control unit 36 stops the energization of the switching unit 101 (process A9). As a result, the engine control is disabled.

Figure 2:
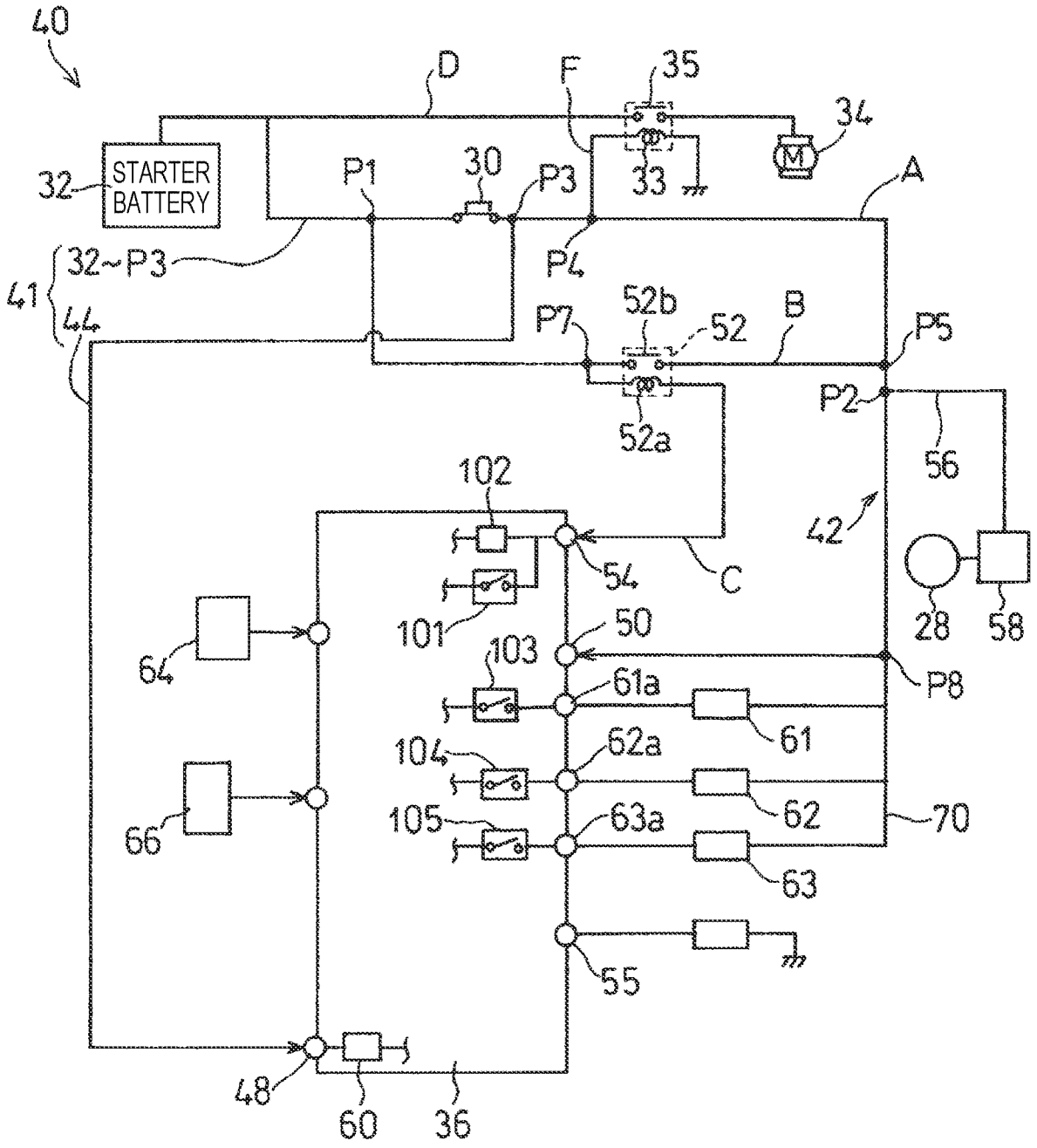
FIG. 2 is a configuration diagram showing the starter system.

According to the above configuration, when there are both the starter signal input from the first circuit 41 and the current input from the second circuit 42 shown in FIG. 2, the control operation of the engine by the electronic control unit is started. Therefore, since the user needs to perform a switch operation to start the engine, it is possible to prevent an undesired engine control from being started. As a result, the reliability of the system is improved. For example, when various functions are incorporated in the electronic control unit 36, it is significant to prevent malfunction and improve reliability of the electronic control unit 36.

The electronic control unit 36 outputs a current supply command of the starter battery 32 to the electronic control unit 36 as a start of the control operation of the engine. Thus, even after the starter switch 30 is operated, the battery supply state to the electronic control unit 36 is maintained, and the current of the starter battery 32 can be used as the drive current. As a result, the operation of the electronic control unit 36 can be prevented from becoming unstable.

By controlling an energization state of the switching element 52 interposed in the post-startup current supply portion B, the battery supply state can be maintained. As a result, the battery supply state to the electronic control unit 36 can be maintained even after the starter switch 30 is operated with the reduced number of wirings.

Since the determination unit 102 determines whether the combustion command can be output based on the electrical state related to the current flowing through the third input unit 54, it is possible to estimate an abnormality in a circuit of a relay system including the relay portion, such as damage or loss of the relay. The electronic control unit 36 can perform the engine control in consideration of a circuit abnormality or the like based on the determination result of the determination unit 102. As described above, when an abnormal state is determined based on a determination result of the determination unit 102, the performing of the engine control is stopped or the output by the engine control is prevented. This allows the user to recognize the abnormal state. For example, availability of the engine control may be determined based on the determination result of the determination unit 102.

The first circuit 41 includes the signal supply portion 44, and the supply of current to the electronic control unit 36 is continued after the switch operation. This eliminates the need for a switch dedicated to power supply to the electronic control unit 36.

The second circuit 42 includes the power generation time supply portion 56 that supplies the generated current from the generator 28 to the electronic control unit 36. Therefore, even in a case where the current supply by the starter battery 32 is instantaneously interrupted due to an impact or the like on the vehicle, it is possible to maintain the current supply to the electronic control unit 36 by maintaining a power generation state. This makes it easy to continue the operation of the electronic control unit 36 after activation.

In a non-output state of the current supply command, the electronic control unit 36 stops the output of the combustion command of the engine. As a result, it is possible to prevent an undesired engine operation in a situation in which a switch operation is not given by the user.

The electronic control unit 36 includes the noise reduction unit 60 that reduces noise of a signal supplied from the first circuit 41 in comparison with a current supplied from the second circuit 42. By setting the voltage threshold value in the noise reduction unit 60, it is possible to increase the noise resistance to the input signal.

By stopping the energization of the switching unit 101 based on the determination of the combustion stop of the engine E, it is possible to prevent the power supply from being continued. As a result, the power consumption of the battery can be reduced. In addition, the energization state of the switching unit 101 may be maintained until a predetermined time elapses after the determination of the combustion stop. As a result, in a case of an undesired engine stop or the like, the engine can be restarted without the operation of the starter switch 30, so that convenience can be improved.

According to the above configuration, even when the contact is lifted and the power supply is instantaneously interrupted, the power supply from the generator 28 and the regulator 58 on the downstream side thereof is maintained. As a result, even when a relatively inexpensive mechanical relay 52 is used, instantaneous interruption of power supply can be prevented. In this way, by the mechanical relay 52 and the regulator 58, it is possible to achieve reduction in the number of components and weight reduction due to omission of a main switch, and to achieve prevention of instantaneous interruption with a low-cost system.

In the present disclosure, the start of the control operation of the engine may include an operation of outputting the current supply command for supplying the current from the battery 32 to the electronic control unit 36.

In this case, the first circuit 41 may include the signal supply portion 44 that supplies a current of the battery as a starter signal to the electronic control unit 36 in response to an operation of the starter switch 30, the second circuit may include the startup time current supply portion A that supplies a current of the battery 32 as a drive current necessary for driving the electronic control unit in response to the operation of the starter switch 30, the post-startup current supply portion B that supplies a current of the battery 32 as the drive current necessary for driving the electronic control unit 36 after the operation of the starter switch 30, and the controllable switching element 52 that is interposed in the post-startup current supply portion B and switches the post-startup current supply portion B between a conductive state and a disconnected state, and the electronic control unit 36 may output a command for controlling the switching element 52 to be in a connection state as a current supply command when there are both the starter signal 48 input from the first circuit 41 and the current input from the second circuit 42.

In this case, the switching element 52 may be an electromagnetic relay including the switch 52*b* interposed in the post-startup current supply portion B and configured to switch a connection state, and the electromagnetic coil 52*a* configured to operate the switch, the starter system further includes the switch current supply portion C in which the electromagnetic coil 52*a* is interposed and which supplies the current of the battery 32 to the electronic control unit 36, separately from the post-startup current supply portion B, the electronic control unit 36 may include the switching unit 101 configured to switch a current supply state to the switch current supply portion C, and the determination unit 102 configured to determine an electrical state related to a current supplied to the electronic control unit 36 via the switch current supply portion C, and the electronic control unit 36 may control the engine based on a determination result of the determination unit 102.

When the current supply command is output, the electronic control unit 36 may stop the output of the combustion command of the engine in a non-output state of the current supply command.

In the present disclosure, the second circuit 42 may include a power generation time supply portion that supplies, to the electronic control unit 36, a generated current from the generator 28 that generates power in accordance with an engine driving force.

In the present disclosure, the electronic control unit 36 may include a noise prevention unit configured to prevent noise of the current supplied from the first circuit 41 in comparison with the current supplied from the second circuit 42.

In the present disclosure, the electronic control unit 36 may determine stop of the output of the current supply command based on determination of combustion stop of the engine.

When the current supply command is output, the electronic control unit 36 may allow the control of the engine at least when the current supply command is output.

A straddle-type vehicle according to the present disclosure includes a starter system according to the present disclosure.

The present disclosure is not limited to the above embodiment, and various additions, modifications, and deletions can be made without departing from the gist of the present disclosure. For example, in the above embodiment, the motorcycle has been described, but the starter switch according to the present disclosure can be applied to a straddle-type vehicle, a three-wheeled vehicle, a four-wheeled buggy, and the like other than the motorcycle. In particular, the starter switch according to the present disclosure is suitably used for a racing vehicle that does not include an auxiliary device, a motocross vehicle in which jump traveling is performed, a vehicle in which weight reduction is required, and the like. In the above embodiment, the electronic control unit 36 determines the supply of the current of the starter battery 32 to the third input unit 54 in addition to the current input to the first and second circuits 41 and 42, and executes the engine control, but the present disclosure is not limited thereto. For example, the determination of the supply of the battery current by the third input unit 54 may be omitted.

The circuit of the above embodiment is an example, and the branch portion and the like can be appropriately changed. For example, a return check circuit may not be provided. In addition, in the above embodiment, the electronic control unit 36 performs a control by turning on and off the current supplied to the electrical components 61 to 63 for a combustion control, but the electronic control unit 36 may perform the control by giving a separate control command to the electrical components for a combustion control instead of turning on and off the current supply. In addition, the main relay 52 is not limited to a mechanical relay, but a semiconductor relay may be used, for example. Therefore, such a configuration is also included in the scope of the present disclosure.

What is claimed is:

1. A starter system comprising: a starter motor configured to start an engine rotationally; an electronic control unit configured to control the engine; a battery that supplies a current to the starter motor; a starter switch capable of supplying the current of the battery to the starter motor in response to an operation by a user; a first circuit that supplies a starter signal indicating that the starter switch is operated to the electronic control unit; a second circuit that supplies a current necessary for driving to the electronic control unit, wherein the electronic control unit starts a control operation of the engine when there are both of the starter signal input from the first circuit and the current input from the second circuit, wherein the start of the control operation of the engine includes an operation of outputting a current supply command for supplying a current from the battery to the electronic control unit, wherein the first circuit includes a signal supply portion that supplies the current of the battery as the starter signal to the electronic control unit in response to the operation of the starter switch, the second circuit includes: a startup time current supply portion that supplies the current of the battery as a drive current necessary for driving the electronic control unit in response to the operation of the starter switch; a post-startup current supply portion that supplies the current of the battery as the drive current necessary for driving the electronic control unit after the starter switch is operated; and a switching element that is interposed in the post-startup current supply portion, the switching element being controllable to switch the post-startup current supply portion between a conductive state and a disconnected state, and the electronic control unit outputs a command for controlling the switching element to be in a connection state as a current supply command when there are both of the starter signal from the first circuit and the current input from the second circuit.

2. The starter system according to claim 1, wherein the switching element is an electromagnetic relay including a switch interposed in the post-startup current supply portion and configured to switch a connection state and an electromagnetic coil configured to operate the switch, the starter system further comprises a switch current supply portion in which the electromagnetic coil is interposed and that supplies the current of the battery to the electronic control unit, the electronic control unit includes a switching unit configured to switch a current supply state with respect to the switch current supply portion, and a determination unit configured to determine an electrical state related to the current supplied to the electronic control unit via the switch current supply portion, and the electronic control unit controls the engine based on a determination result of the determination unit.

3. The starter system according to claim 2, wherein the second circuit is disposed on downstream side of the electromagnetic relay.

4. The starter system according to claim 2, wherein the switch current supply portion branches from an upstream side of the switching element in the post-startup current supply portion.

5. The starter system according to claim 1, wherein the electronic control unit stops output of a combustion command of the engine in a non-output state of the current supply command.

6. The starter system according to claim 1, wherein the second circuit includes a power generation time supply portion that supplies, to the electronic control unit, a generated current from a power generator that generates power in accordance with an engine driving force.

7. The starter system according to claim 1, wherein the electronic control unit includes a noise reduction unit configured to reduce a noise of the current supplied from the first circuit in comparison with the current supplied from the second circuit.

8. The starter system according to claim 1, wherein the electronic control unit determines whether to stop the output of the current supply command based on determination of a combustion stop of the engine.

9. The starter system according to claim 1, wherein the electronic control unit allows to control the engine at least when outputting the current supply command.

10. A straddle-type vehicle comprising:

the starter system according to claim 1.

* * * * *